US006057745A

United States Patent [19]

Sonoda et al.

[11] Patent Number: 6,057,745

[45] Date of Patent: May 2, 2000

[54] DIELECTRIC FILTER, TRANSMITTING/RECEIVING DUPLEXER, AND COMMUNICATION APPARATUS HAVING DEPRESSED PARALLEL PLATE MODE BELOW A RESONANT FREQUENCY

[75] Inventors: Tomiya Sonoda, Muko; Toshiro Hiratsuka, Kusatsu; Yutaka Ida, Otsu; Shigeyuki Mikami; Kiyoshi Kanagawa, both of Nagaokakyo, all of Japan

[73] Assignee: Murata Manufacturing Co., Ltd., Japan

[21] Appl. No.: 09/063,916

[22] Filed: Apr. 21, 1998

[30] Foreign Application Priority Data

Apr. 21, 1997 [JP] Japan ..... 9-103017
Mar. 25, 1998 [JP] Japan ..... 10-077197

[51] Int. Cl.[7] ..... H01P 5/12; H01P 7/10

[52] U.S. Cl. ..... 333/134; 333/202

[58] Field of Search ..... 333/126, 134, 333/26, 33, 202, 204, 219, 219.1

[56] References Cited

U.S. PATENT DOCUMENTS

| | | | |
|---|---|---|---|
| 4,716,386 | 12/1987 | Lait | 333/26 |
| 5,446,729 | 8/1995 | Jachowski | 333/134 X |
| 5,867,073 | 2/1999 | Weinreb et al. | 333/26 |

FOREIGN PATENT DOCUMENTS

| | | | |
|---|---|---|---|
| 0734088 | 9/1996 | European Pat. Off. . | |
| 4-122106 | 4/1992 | Japan . | |
| 9-246820 | 9/1997 | Japan | 333/202 |
| 1381621 | 3/1988 | U.S.S.R. | 333/134 |

OTHER PUBLICATIONS

Patent Abstracts of Japan, vol. 16, No. 381 (E–1248)), Aug. 14, 1992 & JP 04122106 A (Mitsubishi Electric Corp.), Apr. 22, 1992.

Brachat P. et al.: "Dual Polarization Slot–Coupled Printed Antennas Fed by Stripline", IEEE Transactions on Antennas and Propagation, vol. 43, No. 7, Jul. 1 1995, pp. 738–742, XP000513705.

European Search Report dated Jul. 13, 1999, 98106975.0.

"Sub–Millimeter–Wave Band–Pass Filter Using Dielectric Resonator of Planar Circuit Type", C–121, General Meeting of The Institute of Electronics, Information and Communication Engineers, 1996.

*Primary Examiner*—Seungsook Ham
*Attorney, Agent, or Firm*—Ostrolenk, Faber, Gerb & Soffen, LLP

[57] ABSTRACT

In a dielectric filter in which electrodes are formed on both principal planes of a dielectric plate while pairs of electrode non-formed portions having substantially the same shape are defined in the electrodes in opposing relation, areas positioned between the pairs of opposing electrode non-formed portions serve as resonance areas, coupling members are provided to be coupled with the resonance areas, and a cavity is provided to define a space surrounding the resonance areas and the coupling members, a signal is prevented from propagating in the parallel plate mode through a waveguide path formed between electrodes formed on both principal planes of the base plate serving as part of a cavity. Electrodes are formed on both principal planes of a dielectric plate (3) with pairs of electrode non-formed portions **(4*a*, 4*b*, 4*c*, etc.) defined in the electrodes in opposing relation so that areas positioned between the electrode non-formed portions serve as resonance areas. Microstrip lines (9, 10) are provided on an upper surface of a base plate (6), and an electrode (11) is formed in spaced relation from the microstrip lines (9, 10) by a predetermined distance. Through holes (13) for making electrical conduction between the electrodes formed on both principal planes of the base plate (6)** are bored in the base plate in array.

15 Claims, 7 Drawing Sheets

FIG. 1
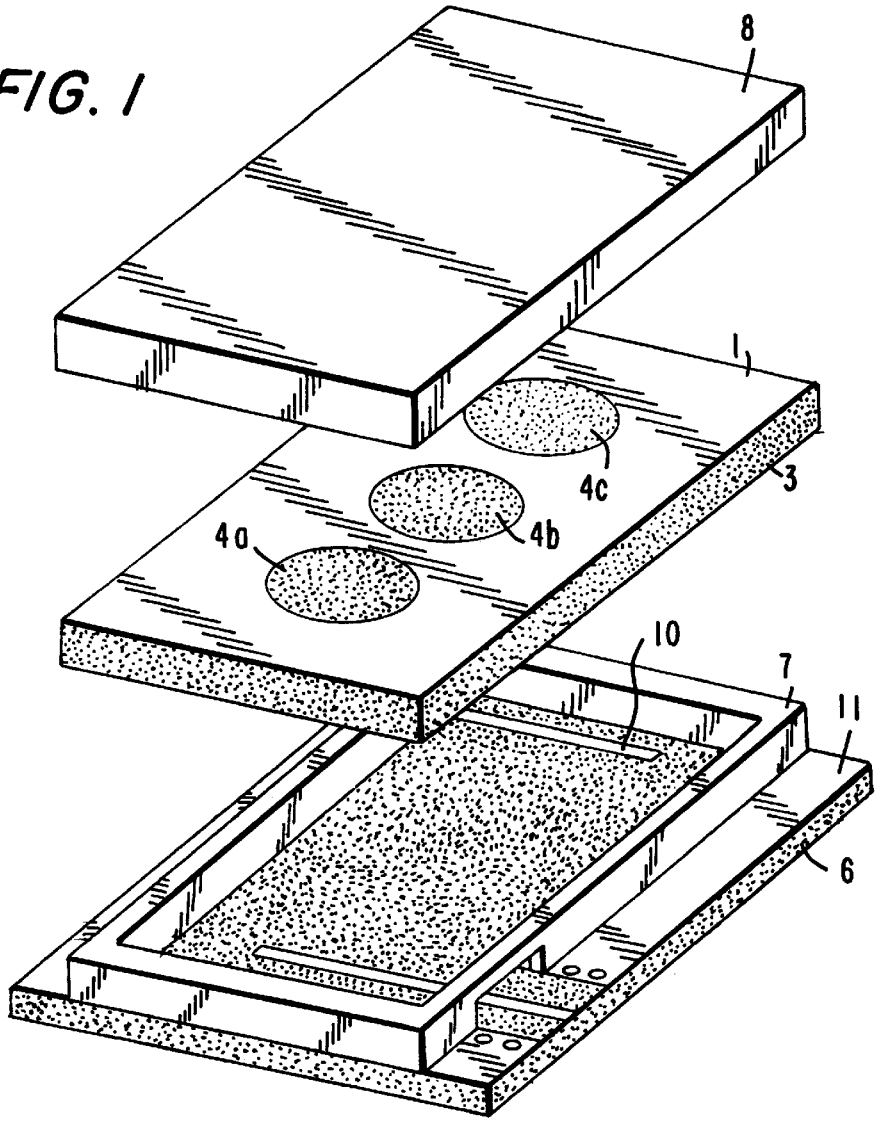
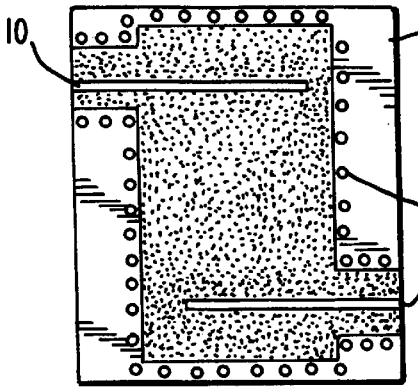
FIG. 2

FIG. 5
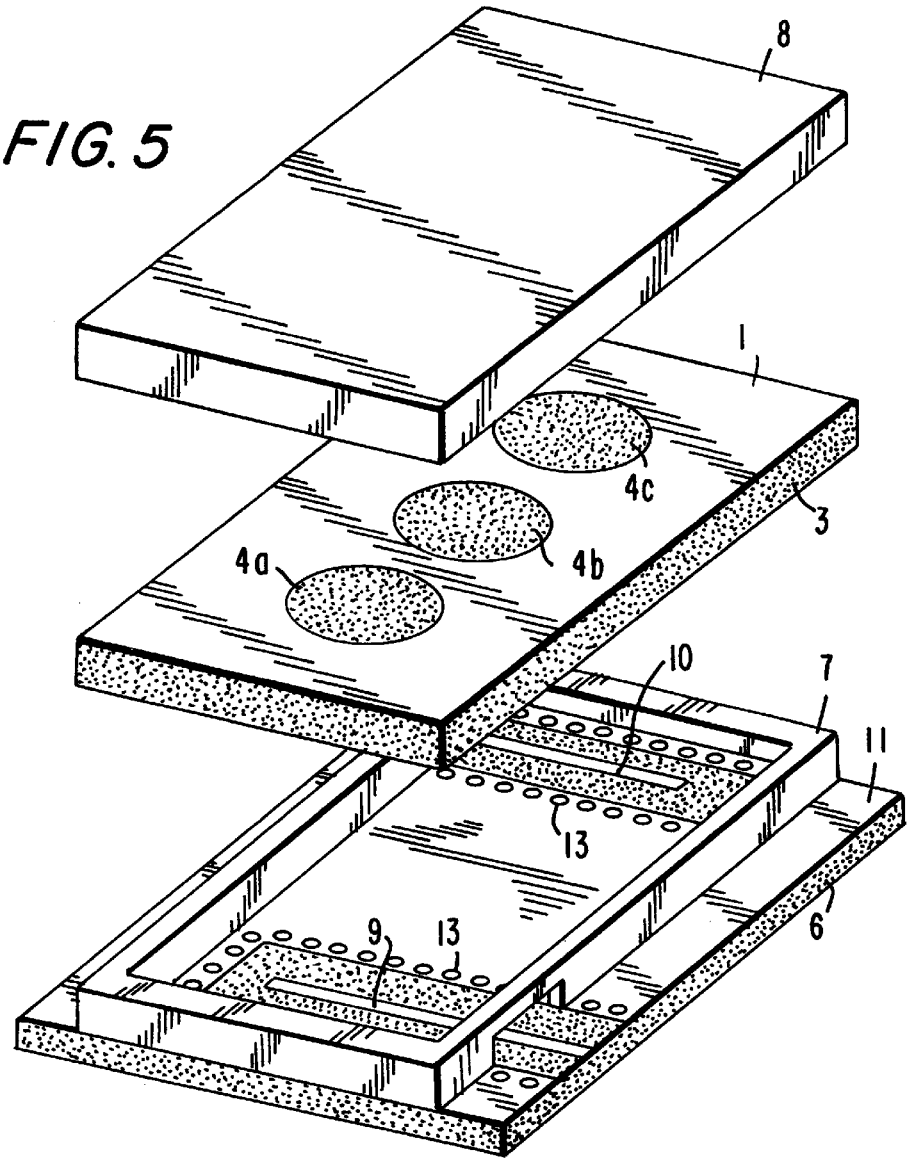
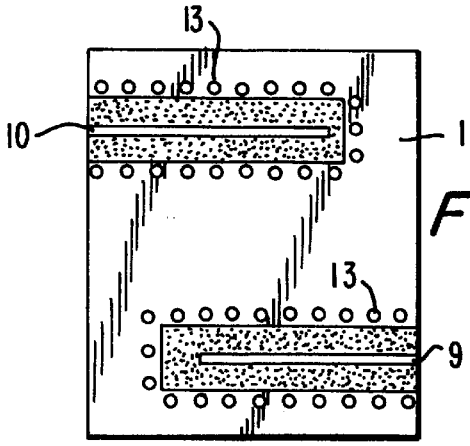
FIG. 6

DIELECTRIC FILTER, TRANSMITTING/RECEIVING DUPLEXER, AND COMMUNICATION APPARATUS HAVING DEPRESSED PARALLEL PLATE MODE BELOW A RESONANT FREQUENCY

BACKGROUND OF THE INVENTION

1. Field of the Invention

The present invention relates to a dielectric filter for use in the bands of microwaves, millimeter waves, etc., as well as a transmitting/receiving duplexer and a communication apparatus each using the dielectric filter.

2. Description of the Related Art

Responding to a demand for high-capacity and high-speed communication systems, it has been hitherto planed to extend the frequency band used for communications from the microwave band to the millimeter-wave band. In particular, using the sub-millimeter-wave band in various systems, such as wireless LAN, portable TV phones and next-generation satellite broadcasting, has been taken into consideration. Correspondingly, there has been a demand for filters which have a reduced size, are more inexpensive, and are superior in mounting onto planar circuits. With the above situation in mind, the inventors of this application proposed "Sub-Millimeter-Wave Band-Pass Filter Using Dielectric Resonator of Planar Circuit Type", C-121, General Meeting of The Institute of Electronics, Information and Communication Engineers, 1996.

The structure of the proposed dielectric filter is shown in an exploded perspective view of FIG. 8. In FIG. 8, denoted by reference numeral 3 is a dielectric plate which has electrodes formed on both principal planes thereof with circular electrode non-formed portions of predetermined size defined in the electrodes in opposing relation. Numeral 1 in the drawing denotes the electrode formed on an upper surface of the dielectric plate 3, and 4*a*, 4*b* denote the electrode non-formed portions. Denoted by 6 is a base plate and 7 is a frame, these members being each made of a ceramic with $\epsilon r=7.3$. Electrodes are formed on a lower surface of the base plate 6, a portion of an upper surface of the base plate 6 extending out of the frame 7, and peripheral portions of the frame 7, thus constituting a lower case. Denoted by 8 is a cover made of a ceramic with $\epsilon r=7.3$. The cover 8 has electrodes formed on its surface held in contact with the electrode 1 and on its peripheral surfaces. Formed on the upper surface of the base plate 6 are microstrip lines, serving as input/-output terminals, one of which is shown at 9. Probes 19, 20 are connected respectively to the microstrip lines.

With the above construction, parts or areas of the dielectric plate 3 positioned between the electrode non-formed portions on both the principal planes function as dielectric resonators in the TE010 mode. The dielectric resonators adjacent to each other are electromagnetically coupled with not only each other but also the probes 19, 20, respectively.

In the conventional dielectric filter having the structure explained above, a waveguide path is constituted in an area where the electrodes are formed on both principal planes of the base plate 6. Accordingly, the waveguide path is coupled with the microstrip lines, causing a signal to propagate inside the base plate 6 in the so-called parallel plate mode. This has raised a fear that the attenuation characteristic and the spurious characteristic of the filter may deteriorate.

For that reason, the conventional dielectric filter has been designed to cut off the coupling between the waveguide path constituted by the electrodes on both principal planes of the base plate 6 and the microstrip lines by forming through holes 13 to make electrical conduction between the electrodes on both principal planes of the base plate 6 in the vicinity of the microstrip line 9, as shown in FIG. 8. However, such a design has been not sufficient in some cases to satisfy specific demanded characteristics. Further, because it is not easy to bore highly accurate holes in the ceramic substrate, the above design pushes up a manufacture cost when ceramics are used as materials of base plates on which the microstrip lines are provided. For the base plate 6 having a high specific inductive capacity, the wavelength of a signal propagating through the waveguide path inside the base plate becomes short. This means that when forming a plurality of through holes in array, it is necessary to set small the array pitch and increase the number of the through holes. Additionally, when the base plate is made of a ceramic, the plate thickness is so thin on the order of 0.2–0.5 mm that the base plate is less convenient in handling.

SUMMARY OF THE INVENTION

An object of the present invention is to provide a dielectric filter which is free from the various problems as set forth above, as well as a transmitting/receiving duplexer and a communication apparatus each using the dielectric filter.

According to a first aspect of the present invention, in a dielectric filter in which electrodes are formed on both principal planes of a dielectric plate while pairs of electrode non-formed portions having substantially the same shape are defined in the electrodes in opposing relation, areas positioned between the pairs of opposing electrode non-formed portions serve as resonance areas, coupling members are provided to be coupled with the resonance areas, and a cavity is provided to define a space surrounding the resonance areas and the coupling members, part of the cavity is constituted by a base plate formed of a dielectric plate or insulating plate with electrodes formed on both principal planes of the base plate, and a plurality of conductor paths for making electrical conduction between the electrodes formed on both principal planes of the base plate are formed in the base plate along portions in contact with the electrodes on the first-mentioned dielectric plate or along portions in contact with another conductor which is in contact with the electrodes on the first-mentioned dielectric plate, aiming to surely prevent a signal from propagating through a waveguide path formed between the electrodes on both principal planes of the base plate.

With that feature, the space surrounding the resonance areas constituted in the dielectric plate and the resonance areas around the coupling members coupled with the former resonance areas is restricted and the space is cut off from the waveguide path formed between the electrodes on both principal planes of the base plate, whereby a signal is prevented from propagating through the waveguide path. Hence, the attenuation characteristic and the spurious characteristic of the filter are improved.

According to a second aspect, when input/output terminals comprising microstrip lines are provided on the base plate, a plurality of conductor paths for making electrical conduction between the electrodes formed on both principal planes of the base plate are formed on both sides of each of the microstrip lines in positions spaced by a distance two to three times a line width of the microstrip lines. With that feature, the coupling between the waveguide path formed between the electrodes on both principal planes of the base plate and the microstrip lines can be held down sufficiently.

According to a third aspect, the conductor paths have an array pitch not larger than ¼ of the wavelength a signal propagating inside the base plate at the central frequency of the dielectric filter. With that feature, the conductor paths formed in the base substrate act as conductor walls for the signal propagating inside the base plate, resulting in an enhanced shield effect.

According to a fourth aspect of the present invention, there is provided a transmitting/receiving duplexer wherein the dielectric filter according to any one of the above first to third aspects is employed as one or both of a transmitting filter and a receiving filter, the transmitting filter being disposed between a transmitted signal input port and an input/output port, the receiving filter being disposed between a received signal output port and the input/output port.

With that feature, a transmitting/receiving duplexer having a superior branching characteristic can be achieved by using the dielectric filter improved in attenuation characteristic and spurious characteristic.

According to a fifth aspect, there is provided a communication apparatus wherein a transmitting circuit is connected to the transmitted signal input port of the transmitting/receiving duplexer according to the fourth aspect, a receiving circuit is connected to the received signal output port of the transmitting/receiving duplexer, and an antenna is connected to the input/output port of the transmitting/receiving duplexer.

BRIEF DESCRIPTION OF THE DRAWINGS

FIG. 1 is an exploded perspective view of a dielectric filter according to a first embodiment.

FIG. 2 is a plan view of a base plate for use in the dielectric filter.

FIG. 5 is an exploded perspective view of a dielectric filter according to a second embodiment.

FIG. 6 is a plan view of a base plate for use in the dielectric filter of the second embodiment.

DESCRIPTION OF THE PREFERRED EMBODIMENTS

Figure 3:
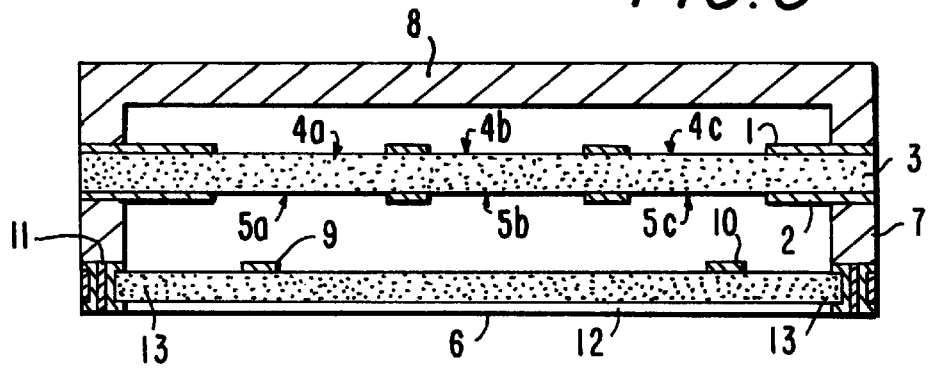
FIG. 3 is a sectional view of the dielectric filter.

The construction of a dielectric filter according to a first embodiment of the present invention will be described below with reference to FIGS. 1 to 4.

FIG. 1 is an exploded perspective view of the dielectric filter. In FIG. 1, denoted by reference numeral 3 is a dielectric plate being 1.0 mm thick and $\epsilon r=30$. An electrode 1 including circular electrode non-formed portions denoted by 4*a*, 4*b*, 4*c* is formed on an upper surface, as viewed on the drawing, of the dielectric plate 3. An electrode including electrode non-formed portions in opposing relation respectively to the electrode non-formed portions 4*a*, 4*b*, 4*c* and having the same shape as them is formed on a lower surface of the dielectric plate 3. With that construction, the electrode non-formed portions opposing to each other function as dielectric resonators in the TE010 mode. Denoted by 6 in the drawing is a base plate being 0.3 mm thick and made of a BT resin with $\epsilon r=3.5$. The base plate 6 has an electrode formed substantially all over its lower surface and an electrode 11 formed on a portion of its upper surface. Formed on the upper surface of the base plate 6 are microstrip lines 9, 10 parts of which serve as probes (coupling members). From above the base plate 6 as viewed on the drawing, a metal-made frame 7 is joined to the electrode 11 on the upper surface of the base plate 6. Additionally, denoted by 8 is a metal-made cover which is joined at its peripheral edges to the electrode 1 on the upper surface of the dielectric plate 3 along peripheral edges thereof.

FIG. 2 is a plan view of the base plate shown in FIG. 1. Referring to FIG. 2, the microstrip lines 9, 10 each have a line width of 0.62 mm and a characteristic impedance of 50 Ω. The electrode 11 is positioned on both sides of a base portion of each of the microstrip lines 9, 10 spaced from the base portion by a distance twice the line width of 0.62 mm. Further, a plurality of through holes 13 for making electrical conduction between the electrode formed on the lower surface of the base plate 6 and the electrode 11 on the upper surface thereof are bored in the base plate 6 in array of a predetermined pitch along inner peripheral edges of the electrode 11, i.e., portions of the electrode 11 joined to the frame 7 shown in FIG. 7, and on both sides of the base portion of each of the microstrip lines 9, 10. The through holes 13 each have a diameter of 0.3 mm and are arranged with the array pitch of 1 mm. Since in this embodiment the central frequency of the dielectric filter is 20 GHz and the wavelength of a signal propagating through the waveguide path inside the base plate is $\lambda g \approx L$ 8 mm, the array pitch of the through holes is a value much smaller than $\lambda g/4$. By arranging the plurality of through holes 13 along the portions of the electrode 11 held in contact with the frame 7 and on both sides of the base portion of each of the microstrip lines as explained above, a waveguide path constituted in an area where the electrodes are formed on both principal planes of the base plate 6 in opposing relation are prevented from coupling with the microstrip lines 9, 10, causing no signals to propagate through the waveguide path.

Consequently, deterioration of the attenuation characteristic and the spurious characteristic of the filter can be avoided.

FIG. 3 is a longitudinal sectional view of the dielectric filter shown in FIG. 1 after being assembled. On the lower surface of the dielectric plate 3, as shown in FIG. 3, there is formed an electrode 2 including electrode non-formed portions 5*a*, 5*b*, 5*c* in opposing relation respectively to the electrode non-formed portions 4*a*, 4*b*, 4*c* on the upper surface of the dielectric plate 3. Three resonance areas 14*a*, 14*b*, 14*c* are thus constituted in the dielectric substrate 3 by the pairs of electrode non-formed portions 4*a*, 4*b*, 4*c*, 5*a*, 5*b*, 5 copposing to each other. An electrode 12 is formed substantially all over the lower surface of the base plate 6. Since the electrode 12 is electrically conducted with the electrode 11 on the upper surface of the base plate 6 via the through holes 13, the electrode 12, the frame 7 and the cover 8 cooperatively function as a cavity surrounding the resonance areas 14*a*, 14*b*, 14*c* and the microstrip lines 9, 10 serving as coupling members. Two resonators constituted by the resonance areas 14*a*, 14*c* are electromagnetically coupled with the microstrip lines 9, 10 serving as coupling members, respectively. Further, two resonators constituted by the resonance areas 14*a*, 14*b* are electromagnetically coupled with each other, and two resonators constituted by the resonance areas 14*b*, 14*c* are electromagnetically coupled with each other. As a result, a three-stage band-pass filter having three resonators is constructed.

Figure 4:
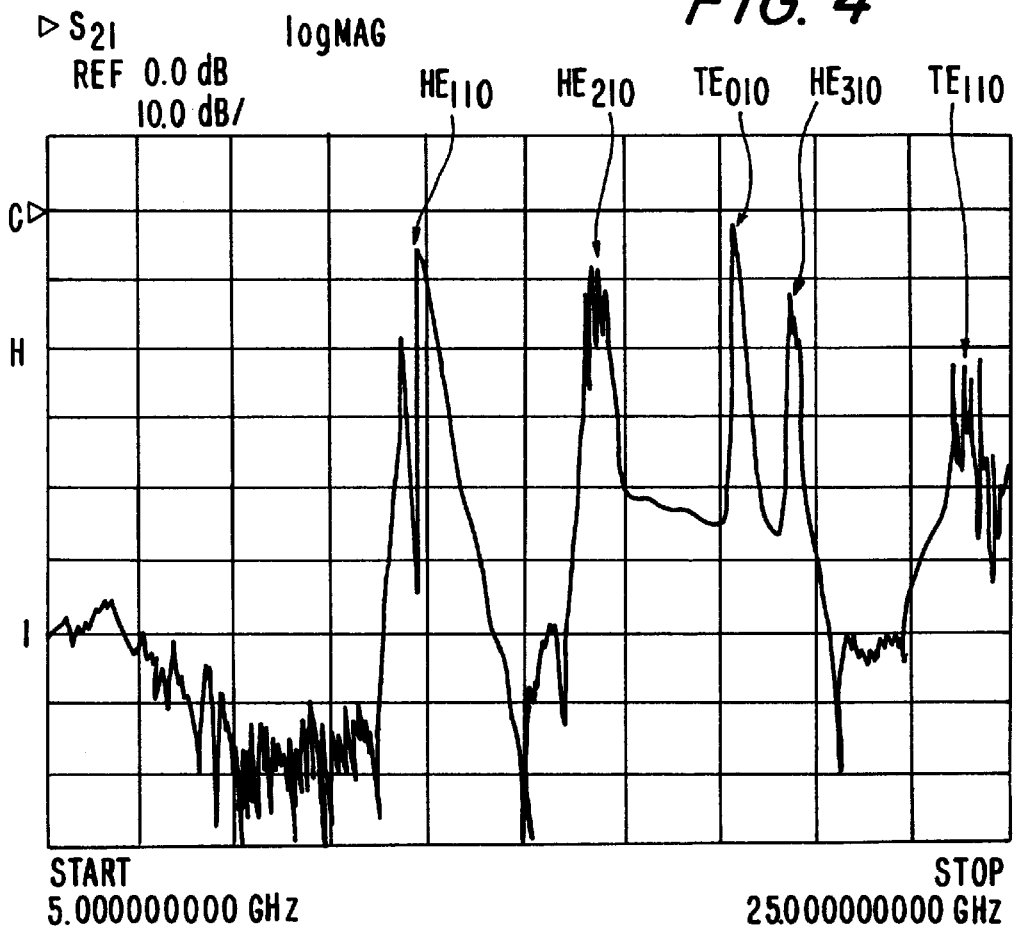
FIG. 4 is a graph showing a wide-band spurious characteristic of the dielectric filter.
Figure 8:
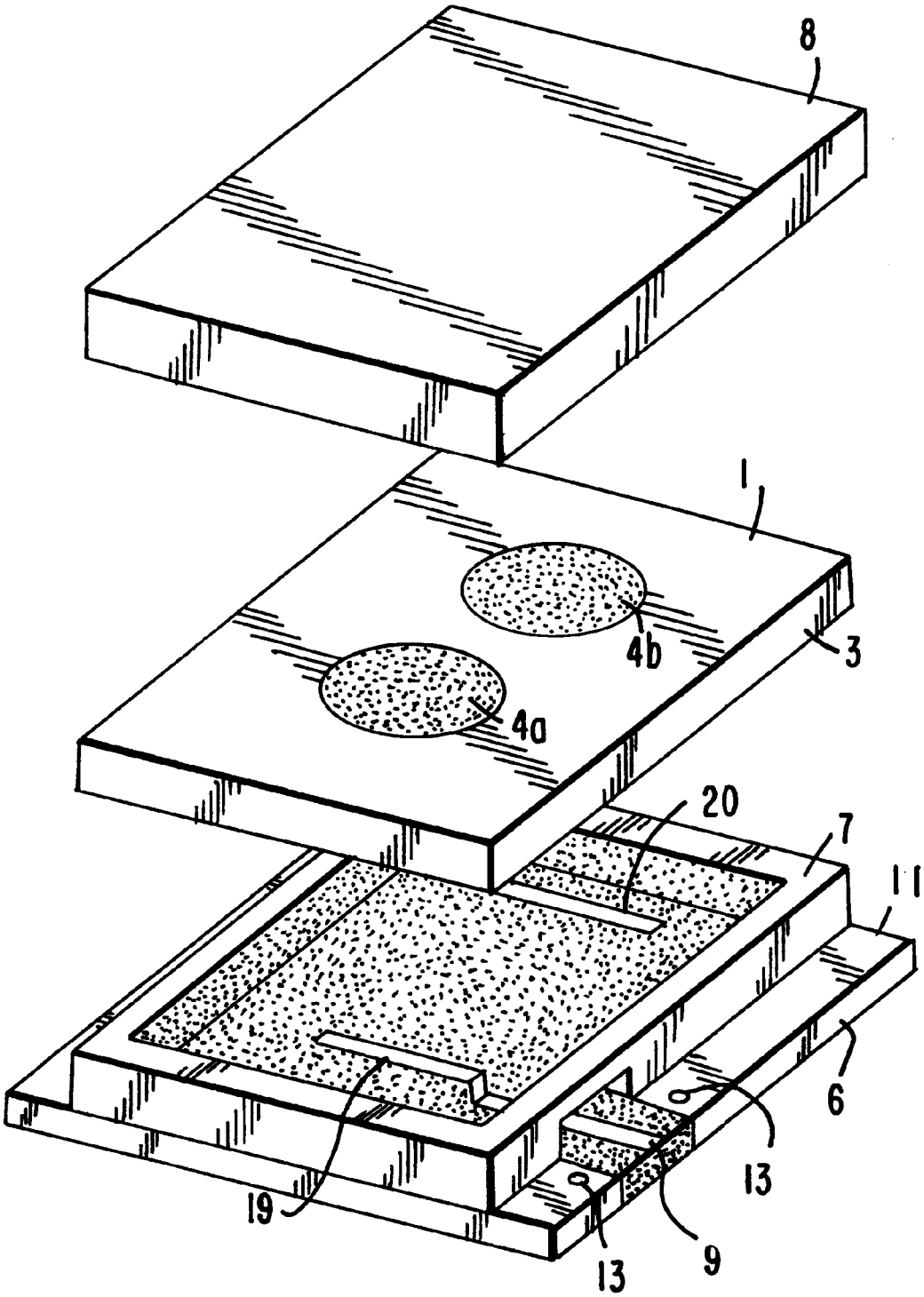
FIG. 8 PRIOR ART
FIG. 8 is an exploded perspective view of a conventional dielectric filter.
Figure 9:
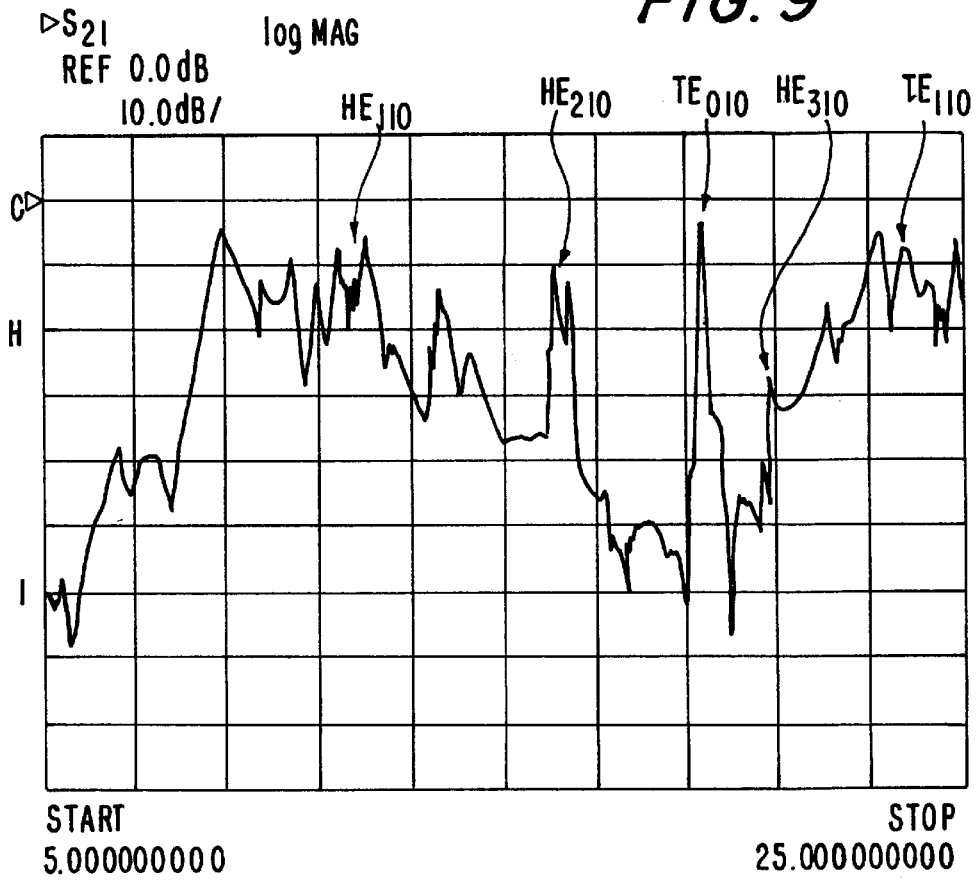
FIG. 9 is a graph showing a wide-band spurious characteristic of the conventional dielectric filter.

FIG. 4 is a graph showing a wide-band spurious characteristic of the dielectric filter according to the first embodiment. As seen from a wide-band spurious characteristic of the conventional dielectric filter shown in FIG. 9, the signal propagating through the waveguide path formed between both principal planes of the base plate in the parallel plate mode is not cut off. The signal in the parallel plate mode therefore propagates even at lower frequency than in the HE110 mode shown in FIG. 9. Particularly, an attenuation value in the range of 9–11 GHz is as low as around 10 dB. By contrast, it is seen from the wide-band spurious characteristic shown in FIG. 4 that an attenuation value in the range of 9–11 GHz is more than 50 dB and the spurious signal occurred in the dielectric filter of the present invention is held down lower than in the conventional dielectric filter shown in FIG. 8. Supposing the case of frequency-doubling an output signal of 10 GHz from an oscillation circuit to obtain a signal of 20 GHz, for example, an output signal from a frequency-doubling circuit contains the signal of 10 GHz. By inserting the filter of this first embodiment in an output line of the frequency-doubling circuit, the signal of 10 GHz can be held down sufficiently. Not that HE110, HE210, HE310 and TE110 in the graph represent resonance modes occurred in the resonators and a response level is not lowered.

AWith the first embodiment, as explained above, a space surrounding the resonance areas constituted in the dielectric plate and the resonance areas around the coupling members coupled with the former resonance areas is restricted and the space is cut off from the waveguide path formed between the electrodes 11 and 12 on both principal planes of the base plate 6, whereby a signal is prevented from propagating through the waveguide path. As a result, the attenuation characteristic and the spurious characteristic of the filter are improved. Also, by forming a plurality of through holes in the base plate 6 along the horizontal sectional shape of the cavity, the resonance frequency of the signal propagating inside the base plate in the parallel plate mode is so increased that the frequency of any higher-order mode of the parallel plate mode is sufficiently separated from the pass band of the mode used for the filter. In addition, by using a printed board with a low dielectric constant to reduce the effective dielectric constant, it is possible to raise the resonance frequency in the base plate (cavity) and further raise the resonance frequency of the signal propagating inside the base plate in the parallel plate mode. Using a printed board with a low dielectric constant also makes longer the wavelength of the signal propagating through the waveguide path inside the base plate. This results in that the array pitch of the through holes can be set relatively large and manufacture of the base plate is easier correspondingly. Moreover, the use of versatile printed boards contributes to not only reduction in cost, but also improvement in handling the base plate.

The construction of a dielectric filter according to a second embodiment will be described below with reference to FIGS. 5 to 9.

FIG. 5 is an exploded perspective view of the dielectric filter and FIG. 6 is a plan view of a base plate for use in the filter. As will be apparent from comparison with FIGS. 1 and 2 which show the first embodiment, a base plate 6 of this second embodiment has an electrode 11 formed on its upper surface including areas inward of the portions onto which a frame 7 is placed or joined, except for areas around microstrip lines 9, 10. A plurality of through holes 13 are bored in the base plate 6 and arrayed in portions defining edges of the electrode 11 around the microstrip lines 9, 10. Further, in this second embodiment, the base plate 6 is formed of an alumina plate with $\epsilon r=10$. The spacing between each of the microstrip lines 9, 10 and the electrode 11 is set to a distance 2–3 times the line width of the microstrip lines 9, 10, and the through holes 13 each having a diameter of 0.3 mm are arranged with the array pitch of 1 mm. Since in this embodiment the central frequency of the dielectric filter is 20 GHz and the wavelength 80 g of a signal propagating through the waveguide path inside the base plate is about 4.7 mm, the array pitch (1 mm) of the through holes 13 is a value much smaller than $\lambda g/4$. The other structure is the same as in the first embodiment.

Figure 7:
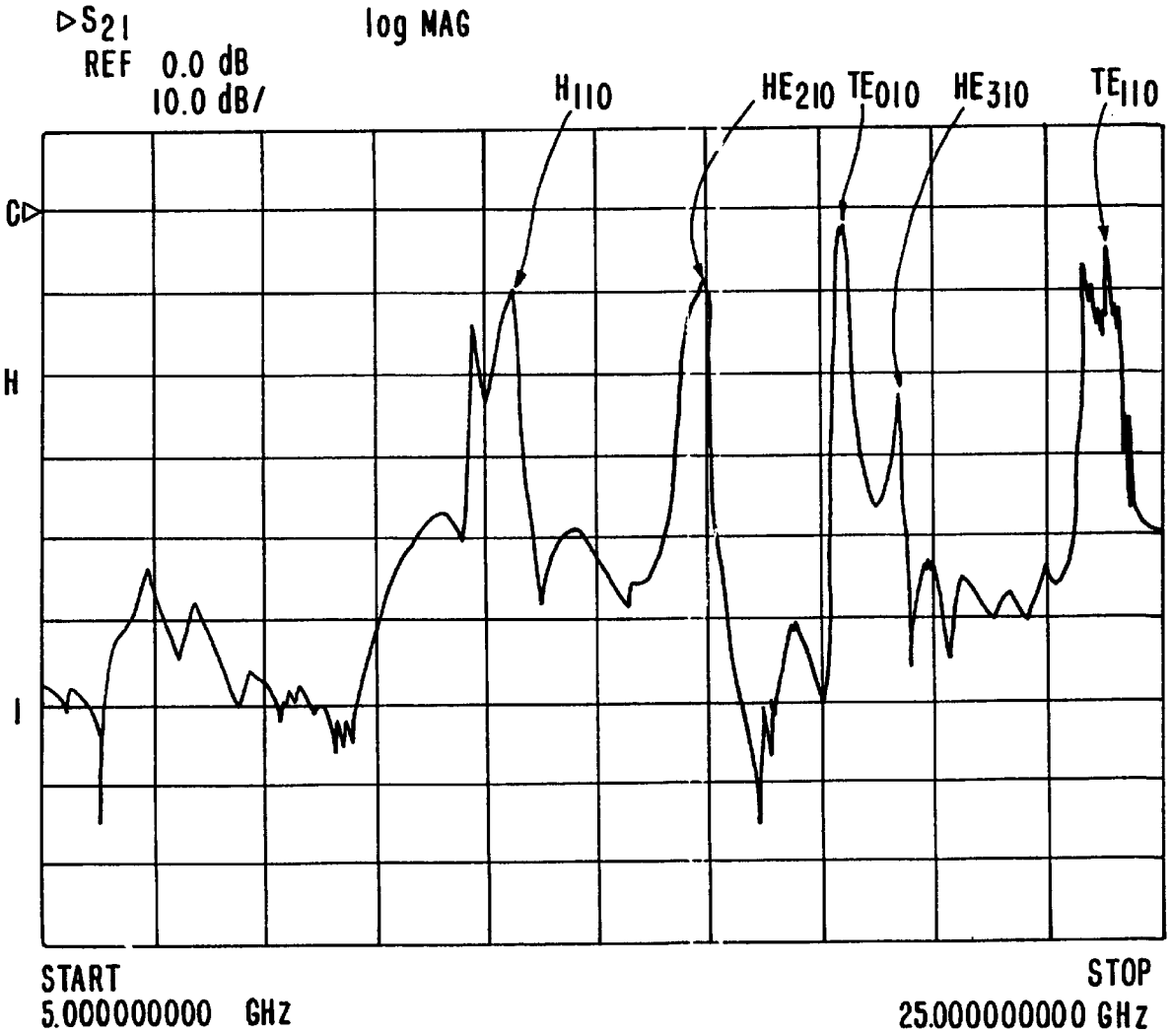
FIG. 7 is a graph showing a wide-band spurious characteristic of the dielectric filter of the second embodiment.

FIG. 7 is a graph showing a wide-band spurious characteristic of the dielectric filter according to the second embodiment. As stated above, in the wide-band spurious characteristic of the conventional dielectric filter shown in FIG. 9, the spurious signal in the parallel plate mode propagates even at lower frequency than in the HE110 mode shown in FIG. 9. Particularly, an attenuation value in the range of 9–11 GHz is as low as around 10 dB. On the other hand, it is seen from the wide-band spurious characteristic shown in FIG. 7 that an attenuation value in the range of 9–11 GHz is more than 50 dB and the spurious signal occurred in the dielectric filter of this embodiment is held down lower than in the conventional dielectric filter shown in FIG. 8.

With this second embodiment, as explained above, by forming the electrode 11 around the microstrip lines, which serve as coupling members, with a predetermined distance left therebetween and boring the through holes around the microstrip lines in array, the spurious signal in the parallel plate mode can be held down effectively even when the specific inductive capacity of the base plate 6 is relatively high.

Figure 10:
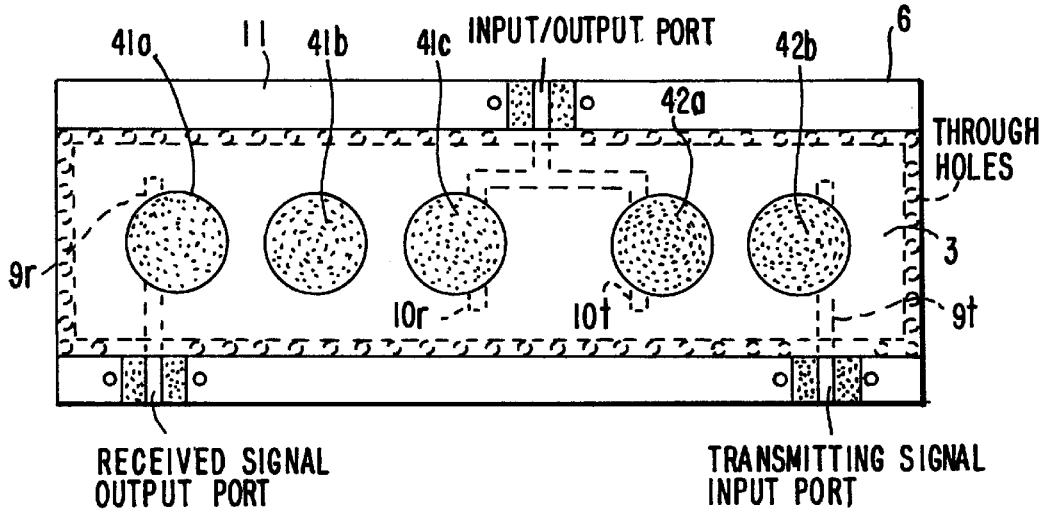
FIG. 10 is a view showing the construction of an antenna duplexer according to a third embodiment.

FIG. 10 shows the construction of a transmitting/-receiving duplexer according to a third embodiment. FIG. 10 is a plan view showing a state where a frame is mounted onto a base plate 6 and a dielectric plate 3 is mounted onto the frame (before mounting a cover). In portions of the base plate 6 to which the frame is joined, through holes are bored in array to made electrical conduction between electrodes formed on both principal planes of the base plate 6. An electrode including five circular electrode non-formed portions denoted by 41*a*, 41*b*, 41*c*, 42*a*, 42*b* is formed on an upper surface of the dielectric plate 3, whereas an electrode including electrode non-formed portions in opposing relation respectively to the above five electrode non-formed portions is formed on a lower surface of the dielectric plate 3. With that construction, five dielectric resonators in the TE010 mode are constituted. Of these five dielectric resonators, three dielectric resonators constituted in areas corresponding to the electrode non-formed portions 41*a*, 41*b*, 41*c* are used as a receiving filter comprised of resonators in three stages. Two dielectric resonators constituted in areas corresponding to the electrode non-formed portions 42*a*, 42*b* are used as a transmitting filter comprised of resonators in two stages.

In the state shown in FIG. 10, a similar cover to that shown in FIG. 1 is joined to the top of the assembly of FIG. 10. With a resulting structure, the electrode on the lower surface of the base plate 6, the through holes and the cover cooperatively establish an electromagnetic shield around the dielectric resonators.

Four microstrip lines 9*r*, 10*r*, 10*t*, 9*t* serving as probes are formed on the base plate 6. End portions of the microstrip lines 9*r*, 9*t* are used respectively as a received signal output port and a transmitted signal input port. Also, end portions of the microstrip lines 10*r*, 10*t* are joined with each other by a microstrip line for line branching and taken out as an input/output port to the exterior. The electrical lengths of the two microstrip lines 10*r*, 10*t* from the equivalent short-circuiting planes to the branched point are determined so that there appears a high impedance respectively when the receiving filter is looked at the wavelength of the transmission frequency and when the transmitting filter is looked at the wavelength of the reception frequency.

Even with a number of resonators arrayed on a single base plate like this embodiment, as explained above, a space surrounding the resonance areas constituted in the dielectric plate 3 and the resonance areas around the coupling members coupled with the former resonance areas is restricted and the space is cut off from the waveguide path formed between the electrodes on both principal planes of the base plate 6 Dwhereby a signal is prevented from propagating through the waveguide path. As a result, a transmitting/receiving duplexer improved in attenuation characteristic and spurious characteristic of both the transmitting filter and the receiving filter and having a superior branching characteristic is obtained.

Figure 11:
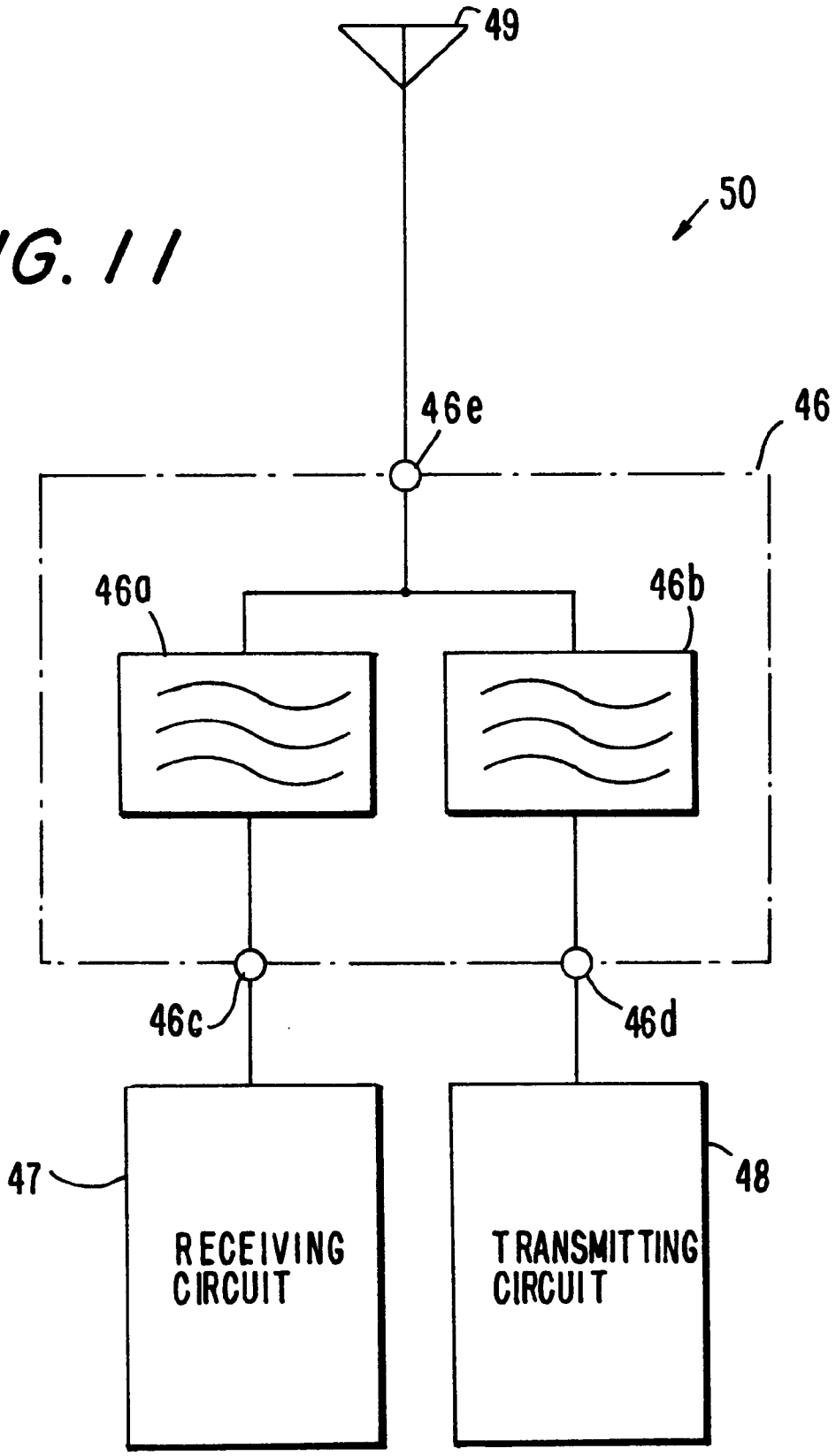
FIG. 11 is a block diagram showing the configuration of a communication apparatus according to a fourth embodiment.

FIG. 11 is a block diagram showing the configuration of a communication apparatus using the above-mentioned transmitting/receiving duplexer as an antenna duplexer. In FIG. 11, 46*a* denotes the above-mentioned receiving filter and 46*b* denotes the above-mentioned transmitting filter, these filters jointly constituting the antenna duplexer. As shown in FIG. 11, a receiving circuit 47 is connected to a received signal output port 46*c* of the antenna duplexer 46 and a transmitting circuit 48 is connected to a transmitted signal input port 46*d* thereof, respectively. An antenna 49 is connected to an antenna port 46*e* of the antenna duplexer 46, thus constituting a communication apparatus 50 as a whole. This communication apparatus corresponds to, for example, a high-frequency circuit portion of a portable telephone or the like.

By employing the antenna duplexer to which the dielectric filter of the present invention is applied, as explained above, a small-sized communication apparatus using the antenna duplexer with a superior branching characteristic can be constructed. It is to be noted that the receiving filter 46*a* and the transmitting filter 46*b* of the antenna duplexer 46 may be constituted by separate single dielectric filters each being, for example, as shown in FIG. 1.

In short, according to the first aspect of the present invention, a space surrounding the resonance areas constituted in the dielectric plate and the resonance areas around the coupling members coupled with the former resonance areas is restricted and the space is cut off from the waveguide path formed between the electrodes on both principal planes of the base plate, whereby a signal is prevented from propagating through the waveguide path. Hence, the attenuation characteristic and the spurious characteristic of the filter are improved.

According to the second aspect of the present invention, the coupling between the waveguide path formed between the electrodes on both principal planes of the base plate and the microstrip lines can be held down sufficiently.

According to the third aspect of the present invention, conductor paths formed in the base substrate act as conductor walls for the signal propagating inside the base plate, resulting in an enhanced shield effect.

According to the fourth aspect of the present invention, a transmitting/receiving duplexer improved in attenuation characteristic and spurious characteristic of both the transmitting filter and the receiving filter and having a superior branching characteristic is obtained.

Finally, according to the fifth aspect of the present invention, a communication apparatus with a high-frequency circuit portion being superior in attenuation characteristic and spurious characteristic is obtained.

What is claimed is:

1. A dielectric filter comprising:

a dielectric plate;

electrodes formed on both principal planes of said dielectric plate; pairs of electrode-free portions having substantially matching shapes defined in said electrodes in opposing relation, wherein regions in said dielectric plate positioned between said pairs of opposing electrode-free portions serve as resonance areas, coupling members are provided to be coupled with said resonance areas, and a cavity is provided to define a space surrounding said resonance areas and said coupling members, wherein:

said cavity is defined in part by a base plate with electrodes formed on both principal planes of said base plate, and a plurality of conductor paths at around an outer boundary said cavity for making electrical connections between said electrodes formed on both principal planes of said base plate are formed in said base plate at portions conductively connected with said electrodes on said dielectric plate.

2. A dielectric filter according to claim 1, wherein said coupling members comprise microstrip lines provided on said base plate, and said plurality of conductor paths for making electrical connections between said electrodes formed on both principal planes of said base plate are formed on both sides of each of said microstrip lines in positions spaced by a distance two to three times a line width of said microstrip lines.

3. The dielectric filter according to claim 1 or claim 2, wherein said dielectric filter has a central frequency, and said conductor paths have an array pitch not larger than ¼ of the wavelength of a signal propagating inside said base plate at said central frequency of said dielectric filter.

4. A transmitting/receiving duplexer comprising a transmitting filter and a receiving filter, said transmitting filter being disposed between a transmitted signal input port and an input/output port, said receiving filter being disposed between a received signal output port and said input/output port, at least one of said transmitting filter and said receiving filter comprising a dielectric filter, said dielectric filter including a dielectric plate, electrodes formed on both principal planes of said dielectric plate, pairs of electrode-free portions having substantially matching shapes defined in said electrodes in opposing relation, wherein regions in said dielectric plate positioned between said pairs of opposing electrode-free portions serve as resonance areas, coupling members provided to be coupled with said resonance areas, and a cavity is provided to define a space surrounding said resonance areas and said coupling members, said cavity being defined in part by a base plate with electrodes formed on both principal planes of said base plate, and a plurality of conductor paths at around an outer boundary said cavity for making electrical connections between said electrodes formed on both principal planes of said base plate are formed in said base plate at portions conductively connected with said electrodes on said dielectric plate, said coupling members in the case of said dielectric filter being a transmitting filter being coupled to said input/output and said transmitted signal port and in the case of said dielectric filter being a receiving filter being coupled to said input/output port and said received signal output port.

5. A communication apparatus comprising, a transmitting/receiving duplexer comprising a transmitting filter and a receiving filter, said transmitting filter being disposed between a transmitted signal input port and an input/output port, said receiving filter being disposed between a received signal output port and said input/output port, at least one of said transmitting filter and said receiving filter comprising a dielectric filter, said dielectric filter including a dielectric plate, electrodes formed on both principal planes of said dielectric plate, pairs of electrode-free portions having substantially matching shapes defined in said electrodes in opposing relation, wherein regions in said dielectric plate positioned between said pairs of opposing electrode-free portions serve as resonance areas, coupling members provided to be coupled with said resonance areas, and a cavity is provided to define a space surrounding said resonance areas and said coupling members, said cavity being defined in part by a base plate with electrodes formed on both principal planes of said base plate, and a plurality of conductor paths at around an outer boundary said cavity for making electrical connections between said electrodes formed on both principal planes of said base plate are formed in said base plate at portions conductively connected with said electrodes on said dielectric plate, said coupling members in the case of said dielectric filter being a transmitting filter being coupled to said input/output and said transmitted signal port and in the case of said dielectric filter being a receiving filter being coupled to said input/output port and said received signal output port, a transmitting circuit connected to said transmitted signal input port, a receiving circuit connected to the received signal output port, and an antenna connected to the input/output port of said transmitting/receiving duplexer.

6. A transmitting/receiving duplexer comprising a transmitting filter and a receiving filter, said transmitting filter being disposed between a transmitted signal input port and an input/output port, said receiving filter being disposed between a received signal output port and said input/output port, at least one of said transmitting filter and said receiving filter comprising a dielectric filter according to claim 3.

7. A communication apparatus comprising the transmitting/receiving duplexer according to claim 6, a transmitting circuit connected to said transmitted signal input port, a receiving circuit connected to the received signal output port, and an antenna connected to the input/output port of said transmitting/receiving duplexer.

8. The dielectric filter according to claim 1, wherein said base plate comprises a dielectric plate.

9. The dielectric filter according to claim 1, wherein said base plate comprises an insulating plate.

10. The dielectric filter according to claim 1, wherein said plurality of conductor paths are formed in said base plate at portions conductively connected with another conductor which is in contact with said electrodes on said dielectric plate.

11. A dielectric filter comprising:

a first insulating plate having upper and lower principal surfaces;

a first planar electrode disposed on said lower surface;

a second planar electrode disposed on said upper surface, said second planar electrode having an first electrode-less portion surrounded by said second electrode;

an input electrode extending from outside to the inner side of said first electrode-less portion;

an output electrode extending from outside to said inner side of said first electrode-less portion;

a plurality of through holes electrically connecting said first and second planar electrodes at around boundary portion between said second planar electrode and said first electrode-less portion;

a second insulating plate disposed above said first electrode-less portion;

a third planar electrode on one principal surface of said second insulating plate, said third planar electrode having plurality of electrode-less portions;

a fourth planar electrode on another principal surface of said second insulating plate, said fourth planar electrode having plurality of electrode-less portions opposing to said electrode-less portions in the third planar electrode respectively so as to form respective resonators, at least one of said resonators being electromagnetically coupled with said input electrode and at least another one of said resonators being electromagnetically coupled with said output electrode; and a metal shield covering said second insulating plate and said first electrode-less portion.

12. A dielectric filter according to claim 11, further comprising:

a second electrode-less portion bridging said first electrode-less portion and the outside of said second planar electrode, said input electrode extending through said second electrode-less portion to outside;

a third electrode-less portion bridging said first electrode-less portion and the outside of said second planar electrode, said output electrode extending through said third electrode-less portion to outside.

13. A dielectric filter according to claim 11, further comprising:

a hollow support member intervening said first and second insulating plate.

14. A dielectric filter according to claim 13, wherein said through holes being located at portions in which said hollow support member contacts with said second planar electrode.

15. A dielectric filter comprising:

a first insulating plate having upper and lower principal surfaces;

a first planar electrode disposed on said lower surface;

a second planar electrode disposed on said upper surface, said second planar electrode having at least first and second electrode-less portions;

an input electrode extending in said first electrode-less portion;

an output electrode extending in said second electrode-less portion;

a plurality of through holes electrically connecting said first and second planar electrodes at around boundary portions of said first and second electrode-less portions;

a second insulating plate disposed above said first electrode-less portion;

a third planar electrode on one principal surface of said second insulating plate, said fourth planar electrode having plurality of electrode-less portions in the third planar electrode respectively so as to form respective resonators, at least one of said resonators being electromagnetically coupled with said input electrode and at least another one of said resonators being electromagnetically coupled with said output electrode;

a metal shield covering said second insulating plate and said first electrode-less portion.

* * * * *